US009130275B2

(12) United States Patent
Liu et al.

(10) Patent No.: US 9,130,275 B2
(45) Date of Patent: Sep. 8, 2015

(54) OPEN-LOOP GPS ANTENNA

(71) Applicant: ASKEY COMPUTER CORP., New Taipei (TW)

(72) Inventors: Chien-Sheng Liu, Chiayi County (TW); Yu-Chien Chan, New Taipei (TW); Kuo-Chao Lo, Taoyuan County (TW); Tzu-Hsuan Chou, Hsinchu County (TW)

(73) Assignee: ASKEY COMPUTER CORP., New Taipei (TW)

( * ) Notice: Subject to any disclaimer, the term of this patent is extended or adjusted under 35 U.S.C. 154(b) by 261 days.

(21) Appl. No.: 13/858,110

(22) Filed: Apr. 8, 2013

(65) Prior Publication Data

US 2014/0139376 A1 May 22, 2014

(30) Foreign Application Priority Data

Nov. 21, 2012 (TW) ..... 101143486 A

(51) Int. Cl.
*H01Q 1/38* (2006.01)
*H01Q 7/00* (2006.01)
*H01Q 9/42* (2006.01)

(52) U.S. Cl.
CPC . *H01Q 1/38* (2013.01); *H01Q 7/00* (2013.01); *H01Q 9/42* (2013.01)

(58) Field of Classification Search
USPC ..... 343/700 MS, 702, 866
See application file for complete search history.

(56) References Cited

U.S. PATENT DOCUMENTS

| | | | | |
|---|---|---|---|---|
| 5,786,793 | A * | 7/1998 | Maeda et al. | 343/700 MS |
| 2005/0259031 | A1 * | 11/2005 | Sanz et al. | 343/895 |
| 2012/0001815 | A1 * | 1/2012 | Wong et al. | 343/749 |

FOREIGN PATENT DOCUMENTS

| | | |
|---|---|---|
| CN | 101273492 | 9/2008 |
| CN | 102280700 | 12/2011 |

OTHER PUBLICATIONS

"Office Action of China Counterpart Application", issued on Jul. 8, 2015, p. 1-6.

* cited by examiner

*Primary Examiner* — Dieu H Duong
(74) *Attorney, Agent, or Firm* — Jianq Chyun IP Office

(57) ABSTRACT

An open-loop GPS antenna configured on an insulation object is provided. The open-loop GPS antenna includes a feed, a high frequency circuit, a low frequency circuit and a ground. The high frequency circuit includes a first end, connected to the feed, and a second end. The low frequency circuit includes a third end and a fourth end. The third end is disposed parallel to the second end so as to couple to the second end and generate a capacitance effect to transmit a signal. The fourth end is connected to the ground.

10 Claims, 4 Drawing Sheets

OPEN-LOOP GPS ANTENNA

CROSS-REFERENCE TO RELATED APPLICATION

This application claims the priority benefit of Taiwan application serial no. 101143486, filed on Nov. 21, 2012. The entirety of the above-mentioned patent application is hereby incorporated by reference herein and made a part of this specification.

BACKGROUND

1. Field of the Invention

The invention relates to a global positioning system (GPS) antenna, and more particularly, to an open-loop GPS antenna.

2. Description of Related Art

As technology advances, current general public communications have been gradually replaced by wireless communications, such as cell phone, personal digital assistant (PDA) with wireless Internet access, global positioning system (GPS) and so forth, which are all within the scope of the wireless communications; however, the wireless communications normally require the use of an antenna for transmitting signal.

Frameworks of the antenna have different types, such as a dipole antenna, a bow-tie antenna and a horn antenna, that each has its own characteristics and performance, wherein the dipole antenna has an omnidirectional field, the bow-tie antenna has a wider operation band, and the horn antenna has a larger gain. However, each type of antenna also has its own relative drawbacks, for instance, the dipole antenna has a smaller gain and a narrower operational band, a field of the bow-tie antenna is much inconsistent when operating at each frequency, the horn antenna is not adapted to be used in a mobile communication and so forth. Therefore, a design of the antenna must be according to actual demands of the various wireless communications.

In terms of GPS antenna, current GPS is mostly using a patch type antenna that resonates at a frequency of 1575.42 MHz and is made of right-hand polarization ceramic dielectric materials as the antenna. The patch type antenna includes components such as a ceramic antenna and a low noise signal module (LNA). Currently, a dimension of the patch type antenna on the market is approximately between 1.2 cm×1.2 cm to 2.5 cm×2.5 cm. Current GPS electronic device becomes more and more strict in terms of slim and light weight requirements, and since a weight and a size of the patch type antenna are more difficult to be reduced, it occupies a certain volume of the wireless electronic device, and as in terms of the slim and light weight requirements, this is no doubt a limitation. Moreover, a production cost of the patch type antenna is also higher.

SUMMARY OF THE INVENTION

The invention provides an open-loop GPS antenna having advantages of being light weight, small volume and low cost.

The invention provides an open-loop GPS antenna adapted to be configured on an insulation object. The open-loop GPS antenna includes a feed, a high frequency circuit, a low frequency circuit and a ground. The high frequency circuit includes a first end and a second end, and the first end of the high frequency circuit is connected to the feed. The low frequency circuit includes a third end and a fourth end, and the third end of the low frequency circuit is disposed parallel to the second end of the high frequency circuit so as to couple to the second end of the high frequency circuit and generate a capacitance effect to transmit a signal. The ground is connected to the fourth end of the low frequency circuit.

In an embodiment of the invention, a linewidth of the high frequency circuit is greater than a linewidth of the low frequency circuit.

In an embodiment of the invention, the second end of the high frequency circuit and the third end of the low frequency circuit are opposite to the ground.

In an embodiment of the invention, a sum of a length of the high frequency circuit and a length of the low frequency circuit is approximately between 4 cm to 6 cm, such as 5 cm.

In an embodiment of the invention, a length of the low frequency circuit is approximately between 2 cm to 4 cm, such as 3 cm.

In an embodiment of the invention, a linewidth of the third end of the low frequency circuit is greater than a linewidth of the fourth end of the low frequency circuit, such that the linewidth of the third end of the low frequency circuit satisfies an impedance matching requirement.

In an embodiment of the invention, the low frequency circuit includes two sections configured in parallel, and a spacing between the two sections is at least 1 mm.

In an embodiment of the invention, the open-loop GPS antenna further includes a flexible printed circuit board, the high frequency circuit and the low frequency circuit are disposed on the flexible printed circuit board, the feed and the ground are respectively configured at a side of the flexible printed circuit board so as to connect to the high frequency circuit and the low frequency circuit.

In an embodiment of the invention, the flexible printed circuit board is fixed on the insulation object by means of adhesion.

In an embodiment of the invention, the flexible printed circuit board includes a first positioning part, and the insulation object includes a second positioning part corresponded to the first positioning part.

According to the foregoing, the open-loop GPS antenna of the invention, via a conductive material, may be manufactured with the high frequency circuit and the low frequency circuit on the flexible printed circuit board. The signal passes through the high frequency circuit after being fed from the feed of the open-loop GPS antenna. Since the third end of the low frequency circuit is coupled to the second end of the high frequency circuit, the capacitance effect is generated at the coupling point of the high frequency circuit and the low frequency circuit so as to transmit the signal to the low frequency circuit. The high frequency circuit and the low frequency circuit, as being configured by means of an open-loop, may form a more favorable antenna radiation field, so as to obtain a larger signal reception and transmission range. In addition, the open-loop GPS antenna of the invention may enable the open-loop GPS antenna to resonant at a frequency of 1575.42 MHz by controlling the lengths of the high frequency circuit and the low frequency circuit, and may attain the impedance matching by adjusting the linewidth of the third end of the low frequency circuit, so as to satisfy a usage requirement of GPS electronic device. Moreover, since the flexible printed circuit board may be bent according to a shape of the insulation object and be adhered on the insulation object, the open-loop GPS antenna has the advantages of small occupied space, light weight and able to provide a greater flexibility in the configuration. Furthermore, when assembling on the insulation object, a correctness of the assembly may be effectively ensured by aligning the first positioning part of the flexible printed circuit board to the second positioning part of the insulation object.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
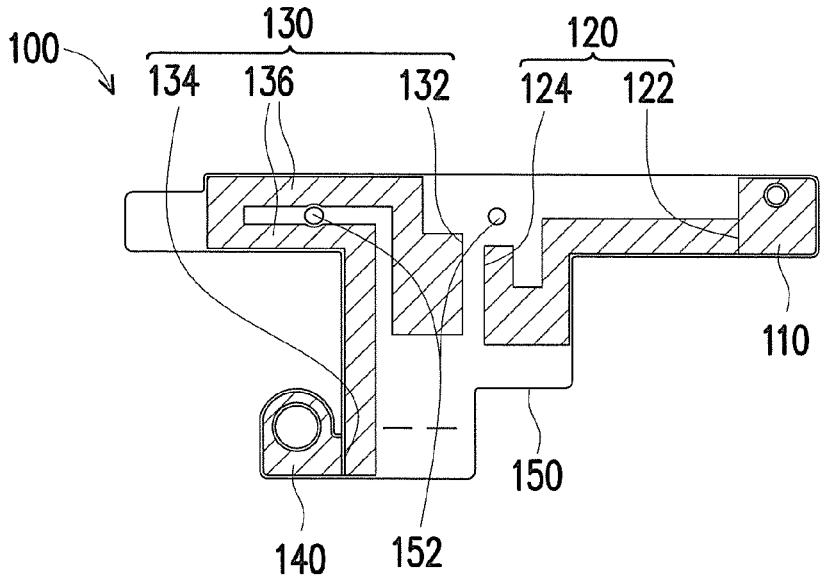
FIG. 1 is a schematic diagram illustrating an open-loop GPS antenna according to an embodiment of the invention.
Figure 2:
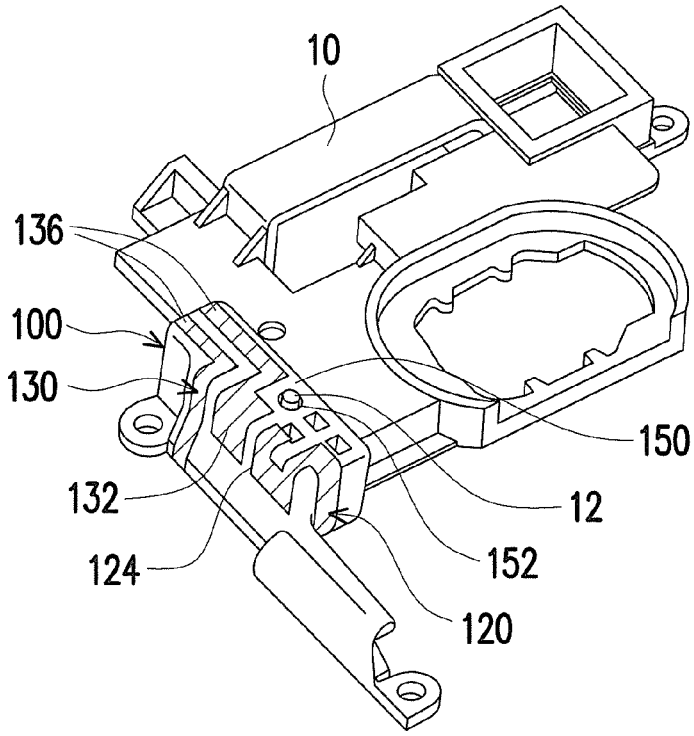
FIG. 2 is a schematic diagram illustrating the open-loop GPS antenna of FIG. 1 being configured on an insulation object.

FIG. 1 is a schematic diagram illustrating an open-loop GPS antenna according to an embodiment of the invention. FIG. 2 is a schematic diagram illustrating the open-loop GPS antenna of FIG. 1 being configured on an insulation object. Referring to FIG. 1 and FIG. 2, the open-loop GPS antenna 100 of the present embodiment is adapted to be configured on an insulation object 10. In the present embodiment the insulation object 10 a plastic piece; in other embodiment, a material of the insulation object 10 may also be a ceramic or so forth; the type of the insulation object 10 is not limited thereto. The insulation object 10 may be a component in within a GPS electronic device (not shown), and since the open-loop GPS antenna 100 has a small volume and is bendable, the open-loop GPS antenna 100 may be directly adhered on the insulation object 10 according to a conformation of the insulation object 10 so as to receive and transmit a GPS signal; this part is to be described in detail below.

As shown in FIG. 1, the open-loop GPS antenna 100 of the present embodiment includes a feed 110, a high frequency circuit 120, a low frequency circuit 130 and a ground 140. The feed 110, the high frequency circuit 120, the low frequency circuit 130 and the ground 140 may be manufactured with conductive materials, such as metal. In the present embodiment, the material of the high frequency circuit 120 and the low frequency circuit 130 is gold or copper, but the material of the high frequency circuit 120 and the low frequency circuit 130 is not limited thereto.

The high frequency circuit 120 includes a first end 122 and a second end 124, and the first end 122 of the high frequency circuit 120 is connected to the feed 110. The low frequency circuit 130 includes a third end 132 and a fourth end 134, and the third end 132 of the low frequency circuit 130 is disposed parallel to the second end 124 of the high frequency circuit 120, so that the third end 132 of the low frequency circuit 130 is coupled to second end 124 of the high frequency circuit 120 and generate a capacitance effect to transmit a signal. The ground 140 is connected to the fourth end 134 of the low frequency circuit 130.

In the present embodiment, by having the third end 132 of the low frequency circuit 130 and the second end 124 of the high frequency circuit 120 configured in parallel and coupled with each other, an effect of capacitance is simulated, and the capacitance effect is generated at the coupling point, so as to reduce lengths of the high frequency circuit 120 and the low frequency circuit 130.

In the present embodiment, a linewidth of the high frequency circuit 120 is greater than a linewidth of the low frequency circuit 130, so that an impedance of the signal is smaller (but, in the present embodiment, the linewidth of the high frequency circuit 120 is not great than a linewidth of the third end 132 of the low frequency circuit 130, this is to be explained in the later part). In addition, as shown in FIG. 2, the second end 124 of the high frequency circuit 120 and the third end 132 of the low frequency circuit 130 are respectively opposite to the ground 140; namely, the second end 124 of the high frequency circuit 120 and the third end 132 of the low frequency circuit 130 are not pointing toward the ground 140, so as to avoid the signal from directly flow to the ground 140 at the second end 124 of the high frequency circuit 120 and the third end 132 of the low frequency circuit 130.

According to a GPS antenna frequency of 1575.42 MHz, in the present embodiment, a fundamental mode of the open-loop GPS antenna 100 is operated at a quarter-wavelength (viz., resonate with a quarter-wavelength). A calculated sum of the lengths of the high frequency circuit 120 and the low frequency circuit 130 is approximately between 4 cm to 6 cm, such as 5 cm. The length of the low frequency circuit 130 is approximately between 2 cm to 4 cm, such as 3 cm. A manufacturer may control a resonance frequency of the open-loop GPS antenna 100 by adjusting the lengths of the high frequency circuit 120 and the low frequency circuit 130. Certainly, the lengths of the high frequency circuit 120 and the low frequency circuit 130 are not limited to the above. In other embodiments, the open-loop GPS antenna 100 may also be resonated with ½ wavelength to calculate the required lengths of the high frequency circuit 120 and the low frequency circuit 130.

In addition, as shown in FIG. 1, the linewidth of the third end 132 of the low frequency circuit 130 is greater than a linewidth of the fourth end 134 of the low frequency circuit 130, such that the linewidth of the third end 132 of the low frequency circuit 130 satisfies an impedance matching requirement; namely, the linewidth of the third end 132 of the low frequency circuit 130 is widened so as to match an impedance (50 Ohm) of an input point of the open-loop GPS antenna 100.

Moreover, in the present embodiment, in order to enable the length of the low frequency circuit 130 to be configured within a limited space, the low frequency circuit 130 is bent to reduce a distribution space thereof. Therefore, as shown FIG. 1, the low frequency circuit 130 includes two sections 136 configured in parallel, and in order to avoid a mutual signal interference from occurring on the two sections 136 of the low frequency circuit 130, a spacing between the two sections 136 has to be greater than 1 mm. Certainly, in other embodiments, if the space is big enough, the low frequency circuit 130 also may not require to be bent and configured in parallel as shown in FIG. 1 (e.g., may be configured in form of a single straight line), so as to avoid the signal from being easily interfered due to different sections of the low frequency circuit 130 being too close to each other.

In the present embodiment, the open-loop GPS antenna 100 further includes a flexible printed circuit board 150, the high frequency circuit 120 and the low frequency circuit 130 are disposed on the flexible printed circuit board 150, the feed 110 and the ground 140 are respectively configured at a side of the flexible printed circuit board 150 so as to connect to the high frequency circuit 120 and the low frequency circuit 130. In the present embodiment, the flexible printed circuit board 150 is fixed on the insulation object 10 by means of adhesion, but in other embodiments, the flexible printed circuit board 150 also may be fixed on the insulation object 10 by means of engagement or screwing; means for fixing the flexible printed circuit board 150 on the insulation object 10 is not limited thereto.

The flexible printed circuit board 150 includes a first positioning part 152, and the insulation object 10 includes a second positioning part 12 corresponded to the first positioning part 152. When the open-loop GPS antenna 100 is adhered on the insulation object 10, the open-loop GPS antenna 100 is ensured to be configured at a correct position on the insulation object 10 through aligning the first positioning part 152 of the flexible printed circuit board 150 to the second positioning part 12 of the insulation object 10.

The open-loop GPS antenna 100 of the present embodiment may manufactures the high frequency circuit and the low frequency circuit coupled with each other with a conductive material on the flexible printed circuit board and may attain characteristic of resonating with the frequency of 1575.42 MHz and impedance matching by adjusting the lengths and the linewidths of the high frequency circuit 120 and the low frequency circuit 130. As compared to a conventional patch type antenna, the open-loop GPS antenna 100 of the present embodiment has advantages of being light weight, small volume and high configuration flexibility.

In order to ensure the open-loop GPS antenna 100 of the present embodiment may substantially satisfy the requirement of the current GPS electronic device, in the following below, an antenna radiation field of the open-loop GPS antenna 100 of the present embodiment and an antenna radiation field of the conventional patch type antenna are compared by means simulation.

Figure 3:
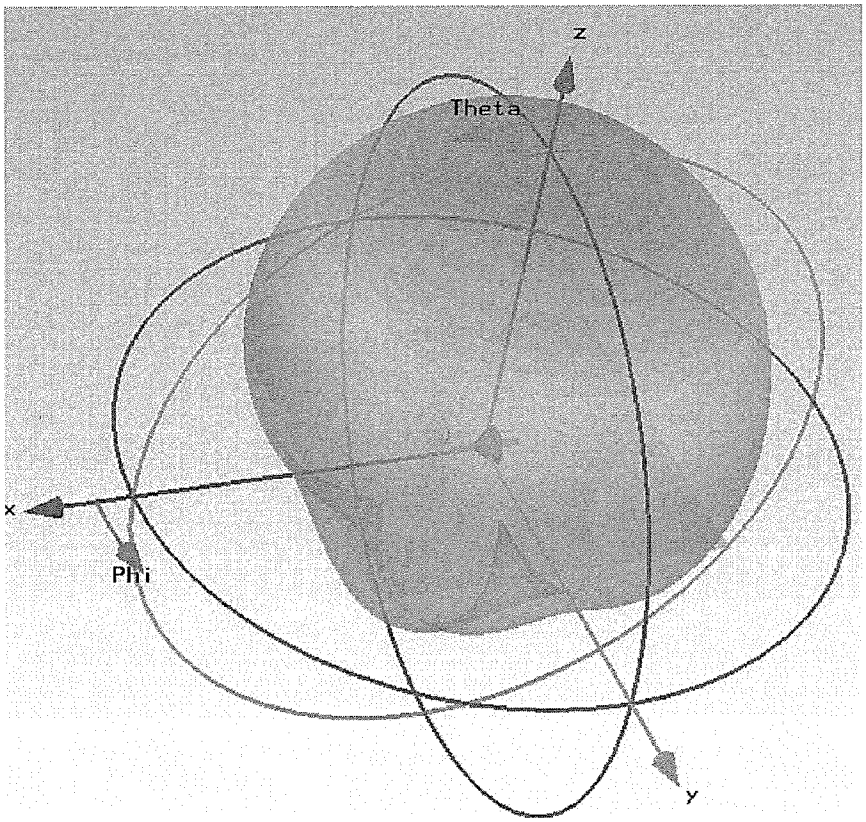
FIG. 3(RELATED ART)
FIG. 3 is a simulation schematic diagram illustrating an antenna radiation field of a conventional patch type antenna.

FIG. 3 is a simulation schematic diagram illustrating an antenna radiation field of a conventional patch type antenna. Referring to FIG. 3, the antenna radiation field of the conventional patch type antenna respectively forms two separate nearly spherical graphics (namely, a so-called upper field and lower field) at the top and the bottom of a Z axis of the figure. As shown in FIG. 3, the sphere of the upper field is larger and more complete, and the sphere of the lower field is smaller. The conventional patch type antenna, via the larger sphere and more complete upper field, may receive and transit a larger range of GPS signals so as to provide a favorable GPS service.

Figure 4:
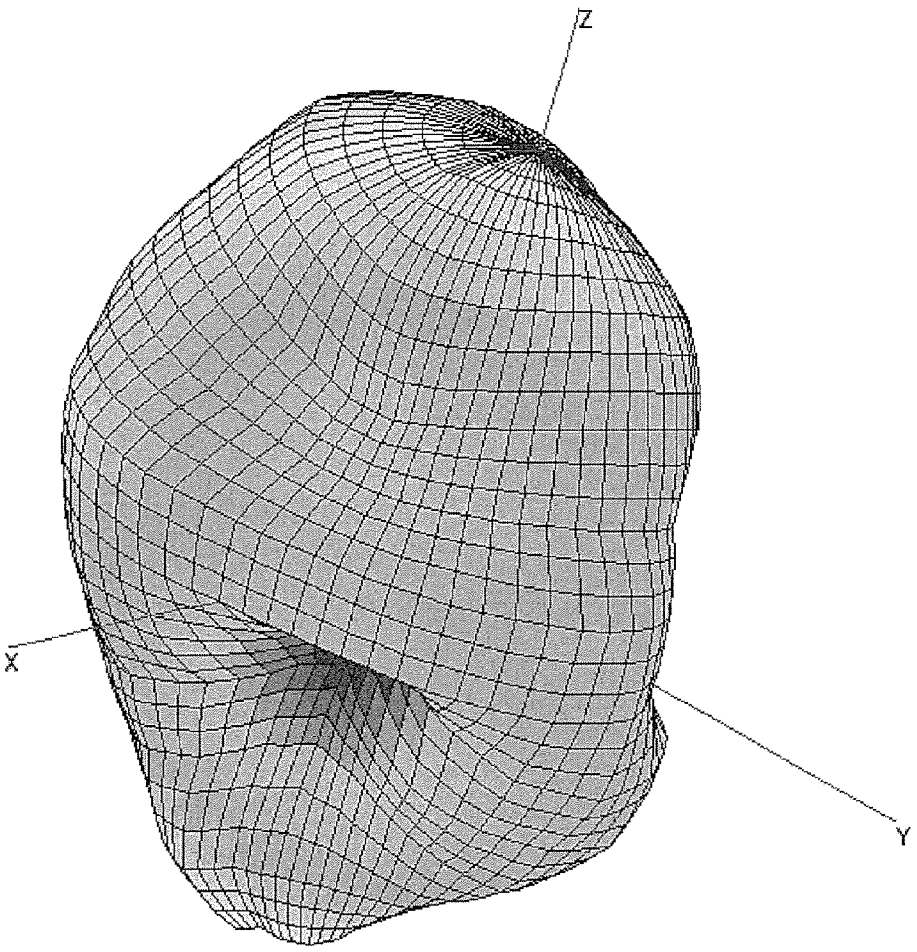
FIG. 4 is a simulation schematic diagram illustrating an antenna radiation field of the open-loop GPS antenna of FIG. 1.

FIG. 4 is a simulation schematic diagram illustrating an antenna radiation field of the open-loop GPS antenna of FIG. 1. Referring to FIG. 4, the sizes of the spheres of the upper field and the lower field of the open-loop GPS antenna 100 of the present embodiment are much closer, but the sphere of the upper field is still larger and more complete than that of the lower field. Therefore, the open-loop GPS antenna 100 of the present embodiment also may satisfy the requirement of the current GPS electronic device and may provide a smaller volume and weight, so that the GPS electronic device may have a smaller appearance and more a flexible interior configuration.

In addition, the high frequency circuit 120 and the low frequency circuit 130 of the open-loop GPS antenna 100 of the present embodiment, as configured by means of an open-loop, may provide a more favorable GPS service. Herein, a stimulation of the antenna radiation field targeting another conventional planar inverted-F antenna (PIFA) is performed.

Figure 5:
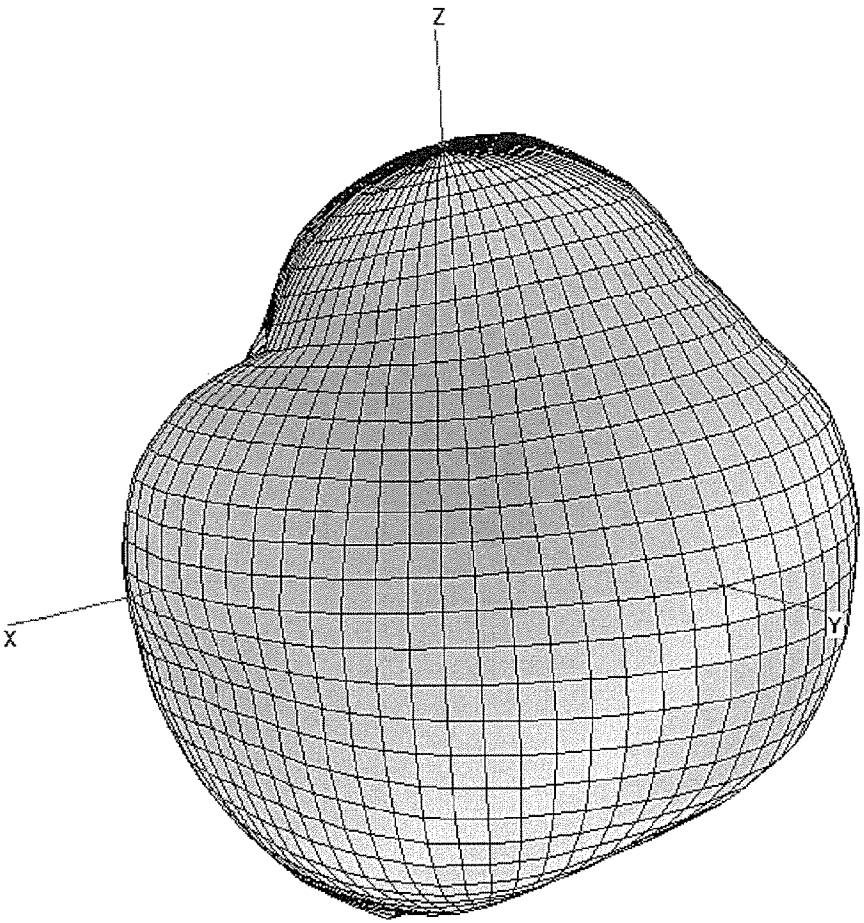
FIG. 5(RELATED ART)
FIG. 5 is a simulation schematic diagram illustrating an antenna radiation field of a conventional planar inverted-F antenna.

FIG. 5 is a simulation schematic diagram illustrating an antenna radiation field of a conventional planar inverted-F antenna. Referring to FIG. 5, the upper field of the conventional planar inverted-F antenna is obviously smaller than the lower field; namely, the conventional planar inverted-F antenna has a smaller range for receiving and transmitting the GPS signals. Therefore, as compared to the conventional planar inverted-F antenna, the open-loop GPS antenna 100 of the present embodiment, through configuring the high frequency circuit and the low frequency circuit by means of the open-loop, provides a more favorable GPS service.

In summary, the open-loop GPS antenna of the invention, via the conductive material, may be manufactured with the high frequency circuit and the low frequency circuit on the flexible printed circuit board. The signal passes through the high frequency circuit after being fed from the feed of the open-loop GPS antenna. Since the third end of the low frequency circuit is coupled to the second end of the high frequency circuit, the capacitance effect is generated at the coupling point of the high frequency circuit and the low frequency circuit so as to transmit the signal to the low frequency circuit. The high frequency circuit and the low frequency circuit, as being configured by means of an open-loop, may form the more favorable antenna radiation field, so as to obtain a larger signal reception and transmission range. In addition, the open-loop GPS antenna of the invention may enable the open-loop GPS antenna to resonant at the frequency of 1575.42 MHz by controlling the lengths of the high frequency circuit and the low frequency circuit, and may attain the impedance matching by adjusting the linewidth of the third end of the low frequency circuit, so as to satisfy the usage requirement of GPS electronic device. Moreover, since the flexible printed circuit board may be bent according to the shape of the insulation object and be adhered on the insulation object, the open-loop GPS antenna has the advantages of small occupied space, light weight and able to provide a greater flexibility in the configuration. Furthermore, when assembling on the insulation object, the correctness of the assembly may be effectively ensured by aligning the first positioning part of the flexible printed circuit board to the second positioning part of the insulation object.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An open-loop GPS antenna adapted to be configured on an insulation object, the open-loop GPS antenna comprising:

a feed;

a high frequency circuit comprising a first end and a second end, the first end of the high frequency circuit connected to the feed;

a low frequency circuit comprising a third end and a fourth end, the third end of the low frequency circuit disposed parallel to the second end of the high frequency circuit, so as to couple to the second end of the high frequency circuit and generate a capacitance effect to transmit a signal; and a ground connected to the fourth end of the low frequency circuit, wherein a linewidth of the high frequency circuit is greater than a linewidth of the low frequency circuit, and the second end of the high frequency circuit and the third end of the low frequency circuit are respectively opposite to the ground.

2. The open-loop GPS antenna as recited in claim 1, wherein a sum of a length of the high frequency circuit and a length of the low frequency circuit is between 4 cm to 6 cm.

3. The open-loop GPS antenna as recited in claim 2, wherein a sum of a length of the high frequency circuit and a length of the low frequency circuit is 5 cm.

4. The open-loop GPS antenna as recited in claim 1, wherein a length of the low frequency circuit is between 2 cm to 4 cm.

5. The open-loop GPS antenna as recited in claim 4, wherein a length of the low frequency circuit is 3 cm.

6. The open-loop GPS antenna as recited in claim 1, wherein a linewidth of the third end of the low frequency circuit is greater than a linewidth of the fourth end of the low frequency circuit, such that the linewidth of the third end of the low frequency circuit satisfies an impedance matching requirement.

7. The open-loop GPS antenna as recited in claim 1, wherein the low frequency circuit comprises two sections configured in parallel, and a spacing between the two sections is at least 1 mm.

8. The open-loop GPS antenna as recited in claim 1 further comprising a flexible printed circuit board, the high frequency circuit and the low frequency circuit disposed on the flexible printed circuit board, the feed and the ground respectively configured at a side of the flexible printed circuit board so as to connect to the high frequency circuit and the low frequency circuit.

9. The open-loop GPS antenna as recited in claim 8, wherein the flexible printed circuit board is fixed on the insulation object by means of adhesion.

10. The open-loop GPS antenna as recited in claim 9, wherein the flexible printed circuit board comprises a first positioning part, and the insulation object comprises a second positioning part corresponded to the first positioning part.

* * * * *